United States Patent [19]

Diamant

[11] 4,406,032

[45] Sep. 27, 1983

[54] TOOTHBRUSH

[76] Inventor: Marcus Diamant, Kungsgatan 1, S-302 45 Halmstad, Sweden

[21] Appl. No.: 245,064

[22] Filed: Mar. 18, 1981

[51] Int. Cl.[3] ..... A46B 9/04

[52] U.S. Cl. ..... 15/167 R; 15/159 A; 128/62 A

[58] Field of Search ..... 15/167 R, 167 A, 110, 15/159 A, 141 R; 128/67, 62 A, 62 R

[56] References Cited

U.S. PATENT DOCUMENTS

| | | | |
|---|---|---|---|
| 2,976,554 | 3/1961 | Hromoko et al. | 15/167 R X |
| 3,939,520 | 2/1976 | Axelsson | 15/167 R |

FOREIGN PATENT DOCUMENTS

| | | | |
|---|---|---|---|
| 517851 | 7/1928 | Fed. Rep. of Germany | 128/62 A |
| 297994 | 10/1928 | United Kingdom | 128/62 A |
| 381843 | 10/1932 | United Kingdom | 128/62 A |

*Primary Examiner*—Peter Feldman

*Attorney, Agent, or Firm*—Ostrolenk, Faber, Gerb & Soffen

[57] ABSTRACT

A toothbrush comprises a brushing head carried by a handle, but the conventional bristles are replaced by brushing means formed of elastically resilient material. The brushing surfaces are defined by turns of filamentary material located to form a head resembling a helical spring or lobes extending substantially transversely or obliquely with respect to the longitudinal direction of the handle.

16 Claims, 4 Drawing Figures

TOOTHBRUSH

BACKGROUND OF INVENTION

This invention relates to a toothbrush, which comprises a handle carrying a brushing head.

Good dental hygiene is considered important for the prevention of dental caries and the regular brushing of teeth and gums is generally recommended for good dental hygiene. Although the recommended technique for brushing teeth has changed in line with recent development, the question has arisen as to whether tooth brushing itself may in some cases cause certain damage, e.g. the wedge-shaped detect that are often found at the transition between the tooth and the tooth neck. Another question that has arisen is whether the formation of the even more common tooth pockets is promoted by the excessive brushing of teeth, since some people brush their teeth intensively, in many cases for some five minutes at a time, several times a day. One reason why teeth are brushed for this relatively long time, is that ideally brushing should be carried out until all bacteria have been removed from the teeth. However, to remove all the bacteria from the teeth by brushing alone is probably quite impossible. Moreover, we all have a bacterial flora in the mouth and throat, and this rapidly spread to the teeth.

OBJECT OF THE INVENTION

The object of this invention is to provide a tooth brushing means which allows satisfactory dental hygiene and at the same time reduces the risk of damage to the teeth and the occurrence of tooth pockets.

SUMMARY OF THE INVENTION

The invention provides a toothbrush in which a brush made up of multiple bristles with free tips on the toothbrush head is replaced by a brushing head of elastically resilient material, the brushing head including a plurality of brushing elements spaced apart in the longitudinal direction of the handle, each element extending substantially across the entire width of the handle. The brushing elements may extend substantially transversely of obliquely of the longitudinal direction of the handle.

The brushing elements may comprise lobes, which are preferably rounded, which project from the handle, or may comprise separate turns of filamentary material which define a brushing surface shaped like part of a helical spring. It is to be appreciated that when the elements comprise rounded lobes, the lobes have a brushing surface which has basically the same extent as a turn of filamentary material or winding, i.e. a continuous contact surface which is much larger than the contact surface of conventional pointed bristles.

The invention also provides a toothbrush comprising a handle, and a brushing head carried by the handle, the head comprising brushing means constructed in the form of a plurality of turns of filamentary material spaced in the longitudinal direction of the handle and disposed substantially transversely of the handle.

In the preferred embodiment the head comprises a filamentary member constructed substantially in the form of a helical spring and having at least some groups of turns separated from adjacent groups of turns.

The toothbrush may comprise two filamentary members, the turns of which alternate. Preferably alternate turns of filamentary material forming the brushing head have different shapes. The turns may have different sizes from one another and, if desired, the brushing surface may be constituted by a flattened portion of the turns.

In order to prevent the turns of filamentary material from catching around the teeth during brushing, the front end at least, i.e. the first turn, of the head may be closed. This can be achieved, for example, by inserting a soft member inside the filamentary coil or in any other suitable way.

Thus like conventional toothbrushes the toothbrush according to the invention comprises a brushing head and a handle bearing the same. However, the brushing head instead of comprising multiple bristles with free tips, comprises an elastically resilient soft member of elasticity adapted to tooth brushing. This also eliminates the risk of the bristle tips of the conventional toothbrush causing local tooth damage and tooth pockets.

The soft member may be constructed in a number of forms appropriate to tooth brushing and from any one of a number of different materials suitable for the purpose. For example, the brushing surface may consist of foam or soft rubber, and the soft member may comprise a substantially spool-shaped, for example, compact or air or liquid-filled "balloon". In the most preferred embodiment, however, the soft member consists of a filamentary member of elastically resilient material constructed substantially in the form of a helical spring and with at least some of the turns of filamentary material or groups of turns of filamentary material separated from adjacent turns of filamentary material or groups thereof. A toothbrush with a soft member constructed in this way is relatively cheap to manufacture and has irregularities which increase the brushing efficiency, and unlike the tips of the bristles of conventional toothbrushes these irregularities cannot cause local tooth damage and tooth pockets.

DESCRIPTION OF PREFERRED EMBODIMENTS

Figure 1:
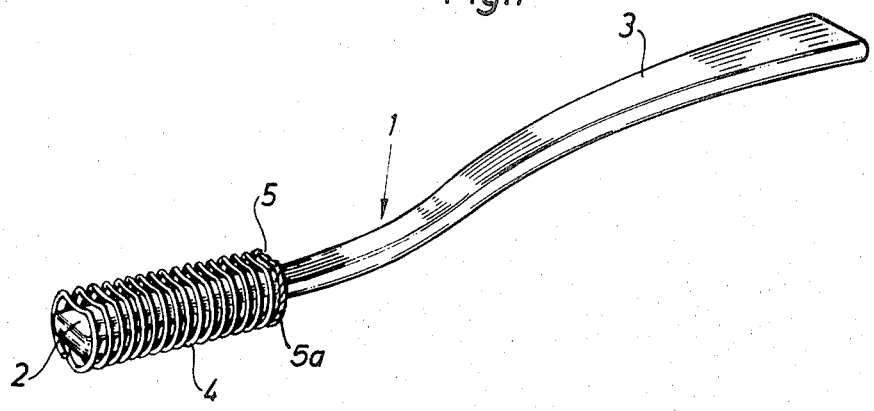
FIG. 1 is a perspective view of a preferred embodiment of a toothbrush constructed in accordance with the invention.

Like conventional toothbrushes, the toothbrush 1 shown in FIG. 1 comprises a brush head 2 and a handle 3 which carries the brush head. Unlike the head of conventional toothbrushes, the head 2 does not comprise a plurality of bristles having free tips. Instead, the brush head comprises an elastically resilient soft member, the elasticity of which is selected so that the member acts satisfactorily when used for cleaning teeth. In the embodiment shown in FIG. 1, the soft member comprises a member 4 of elastically resilient filamentary material, having substantially the form of helical spring. In filamentary material members of this kind it is advantageous for at least some of the filament turns to be separated from adjacent turns, thus producing surface irregularities which increase the brushing efficiency. In the embodiment shown in FIG. 1, therefore, all the filament turns are separated from adjacent turns so that they are situated at substantially constant spacing from one another along the axis defined by the handle 3. The filamentary member 4, is fixed to the handle 3 in any of several ways well known to those versed in the art, e.g. by integral molding, fusing, or gluing, of each of the filament turns in or against the sides of the handle 3. Each turn of the filamentary member 4 has a flattened portion 5 and it is this flattened portion that is intended to be placed against the teeth during brushing. Each turn extends across the entire width of the handle.

As will be apparent from FIG. 1, the flattened portion 5 can, if desired, be dished somewhat transversely of the handle 3. In a somewhat modified embodiment (not shown), every other turn, for example, may have a kink projecting somewhat from the base of the dish shape portion to provide still more surface irregularities to increase the brushing efficiency. Of course these filamentary turns of a somewhat different shape may be associated with a different filamentary member of the same basic construction as the filamentary member 4, the two filamentary members together forming the soft member acting as the toothbrush head.

Figure 2:
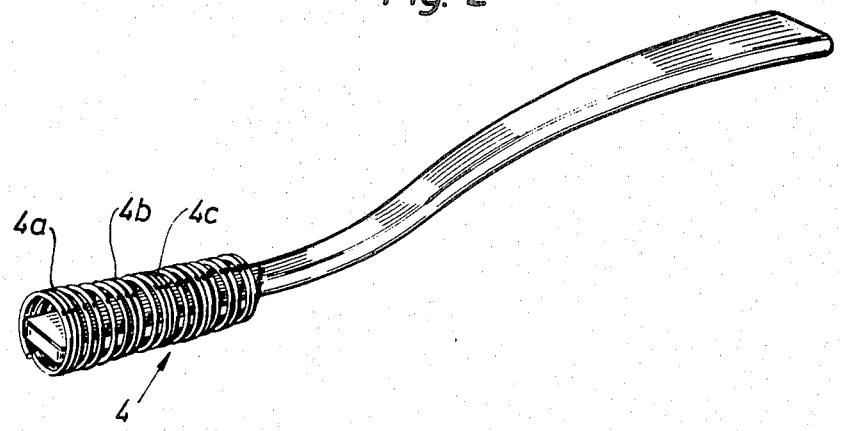
FIG. 2 is a perspective view of another embodiment of a toothbrush constructed in accordance with the invention.

In a modified embodiment illustrated in FIG. 2, the filamentary member 4 is constructed substantially in the form of a helical spring, which does not have any flattened portions as in the embodiment shown in FIG. 1.

In the embodiment shown in FIG. 2 the member 4 consists of groups of filamentary turns 4*a*, 4*b* and 4*c* respectively, which are separated from adjacent groups. Thus the filamentary turns in the groups are close together, but the groups are spaced apart. In a modification not shown in the drawing, the filaments may be very much thinner, in the respective groups.

In the embodiments shown in FIGS. 1 and 2 the individual filamentary turns are substantially at right angles to the longitudinal direction of the handle 3, but in a modification within the scope of the invention the turns may be oblique. Thus the filamentary turns may extend obliquely over the handle. The individual filamentary turns may be of equal diameter as shown in FIGS. 1 and 2 or, if desired, may differ in diameter from one another somewhat. Also the filamentary turns may be disposed closer together or farther apart than shown in FIGS. 1 or 2. It is also possible for each of the individual turns of filamentary material to have its own kinked portion and for those portions to be disposed in such a manner that every other one is situated in a first row on one side of the center line of the region of the brushing head that will brush the teeth and every other one in a second row on the other side of the said center line. The said center line extends, of course, in the direction of the axis of the handle.

The filamentary material, or at least the part thereof that forms the brushing surface, may have irregularities which increase the brushing effect. For example, the filamentary material may be formed from a yarn that is twisted or turned (see 5*a* of FIG. 1) and then thermoset.

Figure 3:
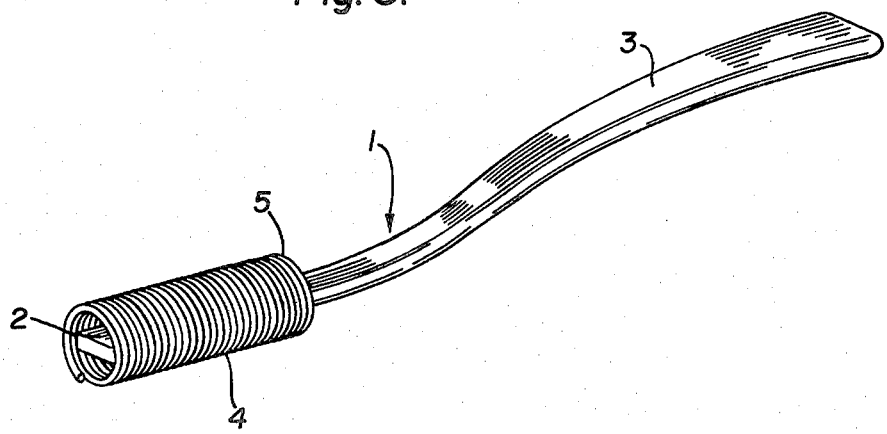
FIG. 3 is a perspective view of a modified form of the toothbrush showing the arc of two coils. The turns of which are alternated.

Two filamentary members may be used as seen in FIG. 3. The turns of which alternate.

The soft member of the toothbrush of the invention which replaces a conventional toothbrush head need not necessarily comprise filamentary material. For example, at least that surface of the soft member which is intended for brushing may consist of foam rubber or soft rubber, or other material suitable for the purpose and known to those versed in the art. Alternatively, the soft member may comprise, for example, a substantially spool-shaped, compact, or air or liquid filled "balloon". In all these modifications it is advantageous, although not essential, for the soft member to have surface irregularities which increase the brushing efficiency, e.g. in the form of longitudinal, transverse or oblique ridges or grooves, or roughenings of any shape, preferably arranged in a regular pattern.

Figure 4:
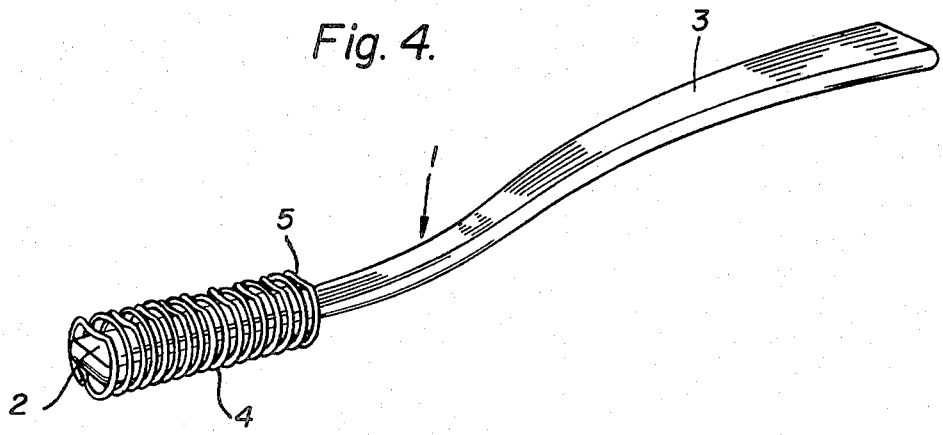
FIG. 4 is a perspective view of a further modified form of the toothbrush in which alternate turns of the coil have different shapes.

Alternate turns may have different shapes as seen in FIG. 4 and may, as seen therein, be of unequal sizes. The front end of the coil may be closed as seen in FIG. 1. Surface irregularities in the coil may be used as seen in FIG. 2 as well as FIGS. 1 and 4.

The elements of resilient material may alternatively be formed by lobes projecting from the handle and having an appropriate contact width or brushing area. The lobes may in such cases, for example, be made in one piece with the actual handle and their length can also be suitably adapted to give the required stability.

Although particular embodiments of the invention have been described and illustrated herein, it is recognised that modifications may readily occur to those skilled in the art and consequently it is intended that the following claims be interpreted to cover such modification and equivalents.

What is claimed is:

1. A toothbrush comprising a handle and a brushing head carried by said handle;

said brushing head including a plurality of brushing filaments spaced apart in the longitudinal direction of the handle, each filament extending substantially across the entire width of the handle, each brushing filament being formed of elastically resilient material;

said brushing filaments defining a brushing surface shaped like part of a helical spring; the turns of the helical spring simulant sections of said brushing head having surface irregularities to increase brushing efficiency;

each of the filament turns being fixed to the sides of the handle and encircle (go on both sides of) the handle.

2. A toothbrush according to claim 1 wherein the brushing elements extend transversely of the handle.

3. A toothbrush according to claim 1 wherein the brushing elements extend obliquely relative to the handle.

4. A toothbrush according to claim 1 wherein the brushing elements are of filamentary material.

5. A toothbrush according to claim 1 wherein the filamentary material comprises a twisted yarn that is thermoset.

6. A toothbrush according to claim 1 wherein the filamentary member has at least some groups of turns separated from adjacent groups of turns.

7. A toothbrush according to claim 1, comprising two filamentary members, the turns of which alternate.

8. A toothbrush according to claim 1 wherein alternate turns of filamentary material forming the brushing head have different shapes.

9. A toothbrush according to claim 1, wherein the various turns of filamentary material have unequal sizes relatively to one another.

10. A toothbrush according to claim 1 wherein the brushing surface of the turns of filamentary material is constituted by a flattened portion of the turns.

11. A toothbrush according to claim 1 wherein at least the front end of the head defined by the first turn is closed.

12. A toothbrush according to claim 1 wherein said filamentary material is elastically resilient.

13. A toothbrush according to claim 1 wherein the head comprises an elastically resilient soft head having a brushing surface shaped like a helical spring and constructed as turns of filamentary material, the elasticity of said surface being adapted to tooth brushing.

14. A toothbrush according to claim 1, wherein the brushing head has surface irregularities to increase the brushing efficiency.

15. A toothbrush comprising a handle and a brushing head carried by said handle;

said brushing head including a plurality of brushing filaments spaced apart in the longitudinal direction of the handle, each filament extending substantially across the entire width of the handle, each brushing filament being formed of elastically resilient material;

said brushing filaments defining a brushing surface shaped like part of a helical spring; the turns of the helical spring simulant sections of said brushing head having surface irregularities to increase brushing efficiency;

wherein said surface irregularities comprise a partial flattening of some of the turns of said helical spring-like structure at the brushing surface of said brushing head.

16. The toothbrush of claim 15, said partial flattening forming hook elements which will participate further in the cleaning of the teeth.

* * * * *